US008118668B2

(12) United States Patent
Gagner et al.

(10) Patent No.: US 8,118,668 B2
(45) Date of Patent: Feb. 21, 2012

(54) APPARATUS AND METHODS FOR AN ACCOUNT BASED GAMING SYSTEM

(75) Inventors: Mark B. Gagner, West Chicago, IL (US); Shridhar P. Joshi, Naperville, IL (US); Erhard W. Rathsack, Reno, NV (US)

(73) Assignee: WMS Gaming Inc., Waukegan, IL (US)

( * ) Notice: Subject to any disclaimer, the term of this patent is extended or adjusted under 35 U.S.C. 154(b) by 80 days.

(21) Appl. No.: 12/524,071

(22) PCT Filed: Feb. 7, 2008

(86) PCT No.: PCT/US2008/001645

§ 371 (c)(1),
(2), (4) Date: Jul. 22, 2009

(87) PCT Pub. No.: WO2008/103246

PCT Pub. Date: Aug. 28, 2008

(65) Prior Publication Data

US 2010/0062843 A1 Mar. 11, 2010

Related U.S. Application Data

(60) Provisional application No. 60/890,575, filed on Feb. 19, 2007.

(51) Int. Cl.
*A63F 9/24* (2006.01)

(52) U.S. Cl. ..... 463/25; 463/29

(58) Field of Classification Search ..... 463/16, 463/25, 29

See application file for complete search history.

(56) References Cited

U.S. PATENT DOCUMENTS

| | | | | |
|---|---|---|---|---|
| 4,856,787 | A * | 8/1989 | Itkis | 273/237 |
| 5,116,055 | A | 5/1992 | Tracy | |
| 6,280,328 | B1 | 8/2001 | Holch et al. | |
| 2003/0148808 | A1 | 8/2003 | Price | |
| 2005/0059481 | A1 | 3/2005 | Joshi et al. | |
| 2005/0176498 | A1 | 8/2005 | Nguyen | |
| 2006/0073889 | A1 | 4/2006 | Edidin et al. | |
| 2007/0060321 | A1 * | 3/2007 | Vasquez et al. | 463/27 |

OTHER PUBLICATIONS

"Sands Video Slots Game", *Sands of the Caribbean Online Casino,* (Sep. 2001), 1-9.

Barnett, Tristan, et al., "Optimizing returns in the gaming industry for players and operators of Video Poker machines", *Proceedings of the 2004 ACM SIGCHI International Conference on Advances in Computer Entertainment Technology,* (2004), 212-216.

Eadington, William R., "The Economics of Casino Gambling", *The Journal of Economic Perspectives,* 13(3), (Summer, 1999), 173-192.

Ennis, Damien Charles, "A Computer Analysis of Hit Frequency for a Complex Video Gaming Machine", Professional paper submitted in partial fulfillment of the requirements for the degree of Master of Science with a major in Computer Science, University of Nevada, Reno, (May 2000).

* cited by examiner

*Primary Examiner* — Omkar Deodhar
(74) *Attorney, Agent, or Firm* — Schwegman, Lundberg & Woessner, P.A.

(57) ABSTRACT

Apparatus, systems, architectures, and methods provide instrumentality to assign a game instance as an account owner in a gaming system and to convey owner functions in the gaming system to the game instance.

44 Claims, 6 Drawing Sheets

APPARATUS AND METHODS FOR AN ACCOUNT BASED GAMING SYSTEM

RELATED APPLICATION

This patent application is a U.S. National Stage Filing under 35 U.S.C. 371 from International Patent Application Serial No. PCT/US2008/001645 filed Feb. 7, 2008, and published on Aug. 28, 2008, as WO 2008/103246 A1, which claims the priority benefit of U.S. Provisional Patent Application Ser. No. 60/890,575 filed Feb. 19, 2007 and entitled "APPARATUS AND METHODS FOR AN ACCOUNT BASED GAMING SYSTEM", the contents of which are incorporated herein by reference in their entirety.

FIELD

Embodiments of the inventive subject matter relate generally to wagering game systems.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

BACKGROUND

Wagering game machine makers continually provide new and entertaining games. One way of increasing entertainment value associated with casino-style wagering games (e.g., video slots, video poker, video black jack, and the like) includes offering a variety of base games and bonus events. However, despite the variety of base games and bonus events, players often lose interest in repetitive wagering gaming content. In order to maintain player interest, wagering game machine makers frequently update wagering game content with new game themes, game settings, bonus events, game software, and other electronic data. Within the gaming industry linked bonus/award systems, such as progressive systems, are widely used to increase player excitement. The progressive awards are generally funded as a function of total coin-in from each participating gaming terminal (GT). A gaming terminal is a wagering game machine with which a player directly interacts to participate in a wagering game. In current typical progressive award products, the progressive system is independent from the GTs and from the casino's slot accounting system. The progressive award system monitors the coin-in on the participating GTs to determine contributions to the award pool. Current progressive-award products have independent hardware and network infrastructure and generally use proprietary protocols to communicate with the attached GTs. This approach typically is costly to design, implement, install, and maintain. Additionally, in current approaches, the system infers its award contributions by monitoring activity on participating GTs. While this approach is generally accurate, errors or differences may occur between the progressive award system and the slot accounting system. This requires periodic reconciliation between these independent systems. Further, participating GTs are associated with a particular progressive award (or group of related awards) in advance. Consequently, there is a need to provide for seamless integration of base wagering games, bonus wager games, game themes, game settings, game software, progressive awards, and other electronic data to ensure an attractive gaming experience.

BRIEF DESCRIPTION OF THE FIGURES

Embodiments of the invention are illustrated by way of example and not limitation in the figures of the accompanying drawings in which.

DESCRIPTION

Various embodiments of the invention are described by way of example and not limitation in the following descriptions.

Figure 1:
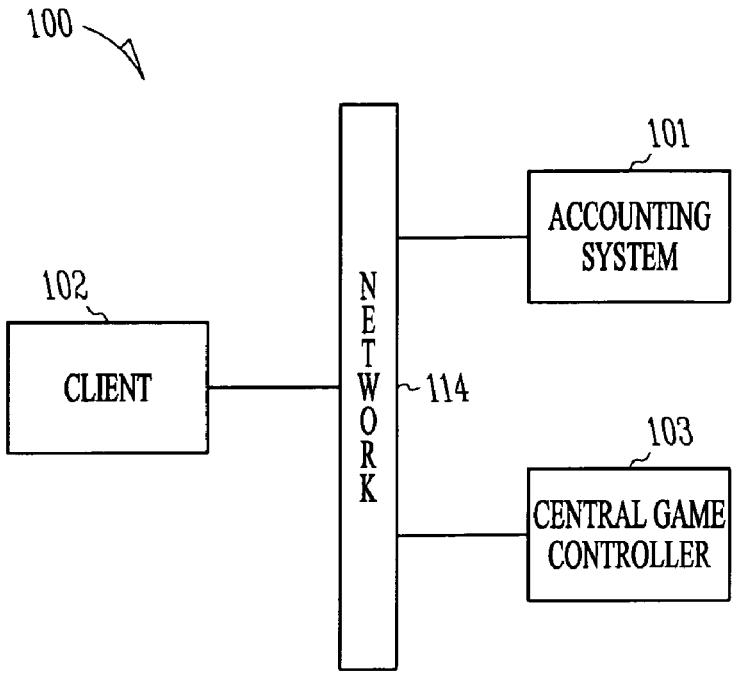
FIG. 1 depicts a block diagram illustrating an embodiment of an architecture for an account based gaming system.

FIG. 1 depicts a block diagram illustrating an embodiment of an architecture for an account based gaming system 100. Account based gaming system (ABGS) 100 includes an accounting system 101 in which account ownership may be assigned to a game instance. Account based gaming system 100 may convey owner functions to the game instance assigned an account in accounting system 101. Herein, an accounting system is a system configured to set up, maintain, control, and track the financial state or transactions of an entity. An account is a formal entity relationship established to provide for regular financial services, financial dealings, and other financial transactions. ABGS 100 may also maintain one or more accounts for a casino, one or more accounts for each casino patron, one or more accounts for each game player, and one or more accounts for casino employees. To support anonymous cash play, ABGS 100 may also maintain a cash account for each GT that is equipped to accept cash or anonymous cash instruments, such as TI/TO (ticket-in/ticket-out) tickets. Herein, a game instance is a game initiated in a machine in a wagering game system. Initiating a game includes configuring and/or starting the game. Such a machine may be a central game controller, a client of a central game controller, an individual wagering game machine, a server, or other machine in which a wagering game may be initiated.

In an embodiment, account based gaming system 100 may include a central game controller 103 and a client 102. Client 102 may reside in central game controller 103. Accounting system 101, central game controller 103, and a client 102 may be operatively interconnected via a network 114. Network 114 may be structured as a communication network in which messages regarding the conducting of financial transactions may be sent. Network 114 may include hardware and software to provide secure financial transactions. Network 114 may be realized as a wired network, a wireless network, or a combination of wired and wireless network. In various embodiments, account based gaming system 100 may include any number of central game controllers and any number of clients associated with one or more of the central game controllers.

In an embodiment, a centralized game controller includes a game engine that executes the logic for a number of game instances concurrently. Each game instance may execute as a separate process on the central game controller. Game instances may be launched on-demand when a player selects a particular game from a menu displayed on a GT that the player is using. A central game controller may also support persistent game instances that run for an indefinite period of time. Persistent games allow one or more players to join and exit from the ongoing persistent game. A persistent game starts based on configuring and starting the game, but unlike a non-persistent game, which may be considered a session, the persistent game runs for an extended period of time. During this period of time, the persistent game accumulates and pays out funds such that a player cashing out or not cashing out has no impact on the game being played. The game keeps running and may continue to run even if there is no player actively connected to it. As the persistent game pays out funds, it may reset its payout to a lower value that increases as the play continues from the reset point.

A progressive has a characteristic of a persistent game in that a progressive award starts with a base reset amount, in which a small percentage of each players bet is subsequently added to this award until a pay event is triggered, where the award resets back to its original amount. A stand alone progressive award is a progressive award that is for one game only. A local area progressive award is a progressive award that is linked to games within a casino. A wide area progressive award is a progressive award that is linked to an entire gaming jurisdiction, such as an entire state. In conventional gaming situations, a progressive is basically not a game, but rather it may be considered to be an award pool. A game running on a particular gaming machine or on a group of gaming machines may be associated with a particular progressive award pool. The progressive award generally is maintained on a completely separate system from the gaming machine or the game instance. The contributions to the progressive award pool are typically not taken into account in the paytable of the gaming machine or the game instance. In operation, each time a game is played on a gaming machine that is attached to the progressive system, the gaming machine reports its total coin-in to the progressive system. The progressive system typically contributes a percentage of the total coin-in to the progressive award. The percentage may be in the range of around 1% of the total coin. In the gaming machine, this contribution is not accounted for in the paytable. Periodically the progressive system interrogates all the attached games and as the coin-in increases, it adds to the award pool by some fixed percentage. The progressive, basically as a completely separate system, has its own computers and its own network to accumulate funds for its award pool from interrogating all the operatively attached games.

A conventional progressive may be won in a couple of different ways. One mechanism is associated with events in a game. For example, a particular progressive award could be associated with the highest award of a gaming machine such that instead of it awarding from the paytable for the highest award, the gaming machine is programmed to contact the progressive system with an indication that the top award was won at the gaming machine. With the progressive prize set to be awarded to the gaming machine at which the highest award is achieved, the progressive system reports back the current amount of the progressive prize, which is the winning amount the game will then award. A second mechanism for winning a progressive may be referred to as a mystery pay. In a mystery pay progressive, the gaming machine itself has no influence over winning the progressive award, other than providing an indication that a game is in play on the gaming machine. A rule for awarding the progressive award resides in the progressive controller. The rule provides for generating the progressive award on the occurrence of a random event not tied to the gaming machine or game play. Thus, the progressive award may be won regardless of the outcome of game play on the gaming machine to which the award is won.

In an embodiment, a progressive may be implemented as a persistent game in a manner similar to other games. A progressive may be implemented as a persistent game instance on a central game controller. Games have logic structures to control displays as game play is executed in software and hardware. A progressive game implemented in this manner may be configured to display content directly on GTs as well as kiosks, overhead signs, and any other devices that can act as a client of a central game controller. In an embodiment, a progressive game is responsible for driving the progressive displays, animations, art, and the behavior of the progressive game. The progressive game instance may have its own account in the accounting system of a wagering game system, rather than being an entirely separate system that counts monetary funds through an inference as to how much is owed to it. The progressive game may be downloaded to a machine configured to run the progressive game, including appropriate equipment such as a random number generator, where the progressive game instance maintains its association to a particular account. In various embodiments, assigning an account to a progressive game instance in an accounting system of an account based gaming system (ABGS) provides a direct path to transfer funds between a player account and an account that is owned by the progressive game instance. Such an architecture for a gaming system may eliminate a significant amount, if not all, of the infrastructure associated with a conventional progressive. For example, a local area progressive (LAP) controller may be eliminated.

In an embodiment, a game instance in a central game controller may act as an agent empowered to perform the same operations as a natural person on an account on an ABGS. As an example, a game instance may be allowed to perform deposits, withdrawals, and transfers between accounts within an ABGS. To implement progressive behavior, a progressive game instance may be assigned ownership of an account in the ABGS that corresponds to the progressive award. Such a progressive game instance may be in a central game controller. When a player chooses to participate in a particular progressive game, a buy-in amount is transferred from the account of the player to the progressive game instance account. The progressive award account increases as deposits are made. In an embodiment, a player may select to join one or more progressive games from a set of different progressive games. A player may also participate in a particular progressive game by buying into the particular progressive game at one of several different buy-in amounts up to a maximum buy-in for the particular progressive game.

In an embodiment, a game instance may have agency over more than one account in an ABGS. For example, a game instance may deposit or transfer a first portion of a contribution to an account that is beneficial to the game developer and/or game publisher and a second portion to an account that corresponds to a progressive award pool. Such a mechanism allows an ABGS to provide detailed accounting for participation entity arrangements. This mechanism also allows the entity participants to have real-time utilization of their participation funds. For example, a particular participation game may make deposits into a specific entity account each time that game is played. Since these funds are owned by the specific entity, these funds may be used in real-time to provide promotional incentives at the discretion of the specific entity. The discretionary use of promotional funds may return funds to the same game instance or may also be used to fund or augment entirely different game instances. For example, a specific entity may choose to direct a portion of its participation receipts into a persistent bonus game, or games, that are only available to players associated with the specific entity.

Since a game instance is an account owner, it may perform financial transactions with other game instances or other automated agents within the ABGS. As an example, a game instance may use funds from its account to purchase casino comps from another system that may be unrelated to the ABGS. These comps could then be used as awards within the game instance.

ABGS 100 may include machine-readable media that have machine-executable instructions that, when performed by a machine in ABGS 100, cause the machine to assign a game instance as an account owner and to convey owner functions in ABGS 100 to the game instance. The machine-readable media may be located in accounting system 101, central game controller 103, or in a combination of both accounting system 101 and central game controller 103. The machine-executable instructions may provide assigning the game instance as an account owner of multiple accounts in the account based gaming system. The machine-executable instructions may include transferring funds from a player account to an account of a game instance. The machine-executable instructions may include transferring funds from a player account to an account of a progressive game instance. ABGS 100 may include machine-readable media that have machine-executable instructions that, when performed by a machine in ABGS 100, cause the machine to execute the game instance on central game controller 103. The game instance executed on central game controller 103 may implement a progressive as the game instance. The machine-executable instructions may include displaying game content of a progressive game on client 102 of central game controller 103. The machine-executable instructions may include executing a progressive game as a multi-level progressive game and providing a player with access to select one or more levels of the multi-level progressive game. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
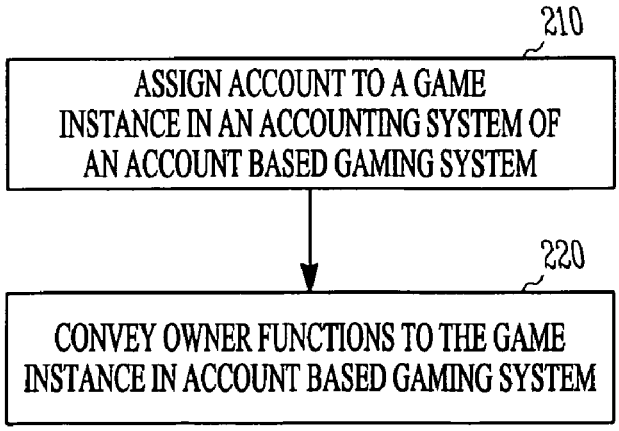
FIG. 2 shows features of an embodiment of a method for operating an account based gaming system.

FIG. 2 shows features of an embodiment of a method for operating an account based gaming system. At 210, an account is assigned to a game instance operatively linked to an account based gaming system. The account may be opened with the generation of the game instance and closed with the termination of the game instance. The assignment of an account to a game instance may be realized in the accounting system in the same manner as which an account is assigned to a person. The game instance may be assigned an account identification and provided with security procedures. In an ABGS system in which a number of casinos and/or individual players are operatively connected, the account identification and security procedures associated with a game instance may also be correlated to individual casinos and/or individual players. Various information regarding the game instance may be stored in memory locations in the ABGS accessible by the accounting system of the ABGS. In an embodiment, a game instance may be assigned as an account owner of multiple accounts in the account based gaming system. In an embodiment, the account of a game instance may be assigned sub-accounts of its main account in the account based gaming system. In an embodiment, a cash account to a gaming terminal may be assigned in an account based gaming system.

At 220, owner functions in the account based gaming system are conveyed to the game instance. A game instance may be allowed to perform deposits, withdrawals, and transfers between accounts within an ABGS. The game instance may be the owner of one or more accounts. The game instance may be allowed to own an account with another entity set as the beneficiary of the account. In an embodiment, a progressive game instance may allot an amount of funds into a progressive award account and may allot an amount of funds to a discretionary account. The funds in the discretionary account are independent of progressive award and its associated account. The funds in the discretionary account may be transferred to another account, which may be owned by the progressive game owner, progressive game publisher, or other entity. Alternatively, the funds that are separate from the progressive award may be transferred directly from the account of the progressive game instance to another party such as, but not limited to, progressive game owner, progressive game publisher, other entity, or apportioned to combinations of parties. Once funds are transferred to another entity, the funds belong to the other entity, which may use the funds in any manner designed by the other entity. Conveying account ownership functions to at gaming instance provides a convenient way to separate funds into one or more accounts with different beneficiaries. In addition, the funds may be generated in the progressive game instance in various ways including, but not limited to, the making of side wagers in the progressive game or another wagering game linked to the progressive game instance.

In an embodiment, the game instance may be executed on a central game controller. The game instance may be executed in an individual gaming machine. The game instance may be executed in a server on a network. In whatever format the game instance is executed, the game instance may be tied to an account in an accounting system. A progressive may be implemented as a game instance. Upon selection of a progressive game by a player, funds may be automatically transferred from the player account to an account of the progressive game. In an embodiment, a game instance may be realized as a progressive game in which executing the progressive game includes displaying and controlling game content on a client of a central game controller. A player may be provided with access to select one or more levels of a multi-level progressive game.

Figure 3:
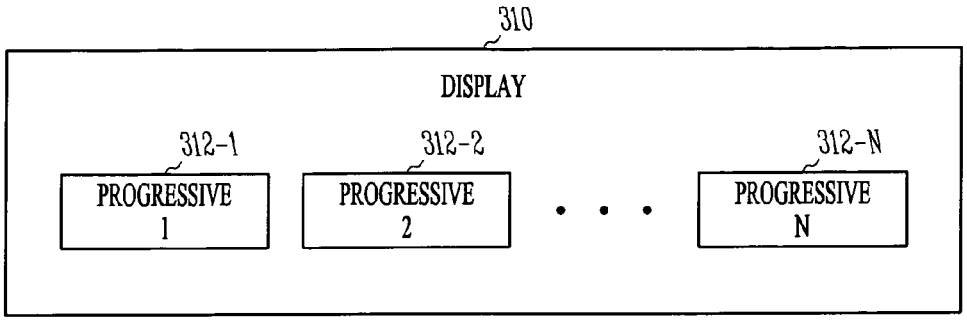
FIG. 3 illustrates an embodiment of features of a display presented to a player for selection of play in one or more progressive games.

FIG. 3 illustrates an embodiment of features of a display 310 presented to a player for selection of play in one or more progressive games 312-1, 312-2, . . . 312-N. Associated with each progressive game 312-1, 312-2, . . . 312-N is accounts owned by each progressive game instance in an accounting system of an account based wagering system. As a player selects one of progressive games 312-1, 312-2 . . . 312-N, the selection event may initiate transfer of funds from the player's account to the account of the progressive game instance corresponding to the selection. Alternatively, the selection event may create an association between the game instance in which the player selection is made and the progressive game instance. As a player selects another one of progressive games 312-1, 312-2 . . . 312-N, the selection event initiates transfer of funds from the player's account to the account of the progressive game instance corresponding to this selection. Each of progressive games 312-1, 312-2, . . . 312-N may be displayed to the player as having different progressive awards. The selection may be provided through activation of a touch screen, activation of one or more buttons on a wagering game device or system, clicking of a computer-like mouse, activation of a screen display using electromagnetic stimulus wirelessly generated, or combinations of various selection actions. Progressive games 312-1, 312-2, . . . 312-N may be exhibited on display 310 on a wagering game machine as part of the choices available with the wagering games that may be played on the wagering game machine. Alternatively, progressive games 312-1, 312-2, . . . 312-N may be revealed as a bonus game. Progressive game 312-1, 312-2, . . . 312-N may be used in a bonus game in a variety of ways. The bonus award may be distributed among progressive games 312-1, 312-2, . . . 312-N at the discretion of the player. Information about each game and possible winnings may be provided on the display to aid the player in the selection of the progressive games to be joined and the amount to be distributed to the selected game. The player may be given the option to not participate in a progressive game and to apply the bonus in another manner. In an embodiment, progressive games 312-1, 312-2, . . . 312-N may be exhibited on display 310 as a mechanism for a player to place a side wager, while playing another game at a wagering game machine.

Figure 4:
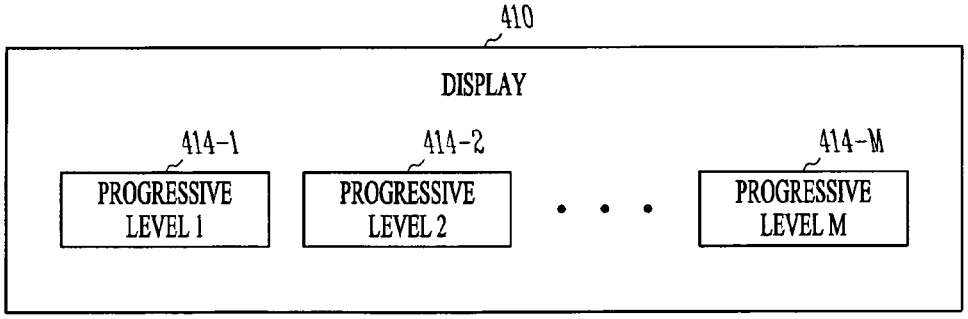
FIG. 4 illustrates an embodiment of features of a display presented to a player for selection of play at one or more levels in a progressive game.

FIG. 4 illustrates an embodiment of features of a display 410 presented to a player for selection of play at one or more progressive levels 414-1, 414-2, . . . 414-M in a progressive game. Progressive levels 414-1, 414-2, . . . 414-M may correspond to an effective wager amount in a progressive game. Each of progressive levels 414-1, 414-2, . . . 414-M may be associated with different progressive awards. Progressive levels 414-1, 414-2, . . . 414-M may be made visible on display 410 following of the selection of a progressive game. Alternatively, progressive levels 414-1, 414-2, . . . 414-M may be made visible on display 410 such that selection of a wager amount selects a set of progressive games. The set of progressive games may be a single game tied to the progressive level selected or may be multiple games from which the player may select one to enter at the amount previously selected. Progressive levels 414-1, 414-2, . . . 414-M allow a player to make a wager in the selected progressive game at one or more different amounts. As a player selects one of progressive levels 414-1, 414-2, . . . 414-N, the selection event initiates transfer of funds from the player's account to the account of the progressive game instance in the amount corresponding to selection. As a player selects another one of progressive levels 414-1, 414-2, . . . 414-N, the selection event initiates transfer of funds from the player's account to the account of the progressive game instance in the amount corresponding to this selection. The selection may be provided through activation of a touch screen, activation of one or more buttons on a wagering game device or system, clicking of a computer-like mouse, activation of a screen display using electromagnetic stimulus wirelessly generated, or combinations of various selection actions.

In an embodiment, a player may select progressive games and also be entered into a mystery progressive game by entering a wagering game tied to the mystery progressive award. Upon entering these games, funds are transferred to the account of each progressive game instance associated with the player selection of progressive games and funds are transferred to the account of the mystery progressive game instance associated with the player entry of the wagering game. If the player's wagering game is associated with winning the mystery progressive game, funds corresponding to the mystery progressive award are transferred to the player's account. In an embodiment, identification of the player or player account as a progressive award winner or mystery progressive award winner to the accounting system triggers transfer of the appropriate award to the player's account, where the accounting system does not track the players or player accounts entered into the progressive games. Alternatively, the accounting system may track the players or player accounts entered into the progressive games.

Figure 5:
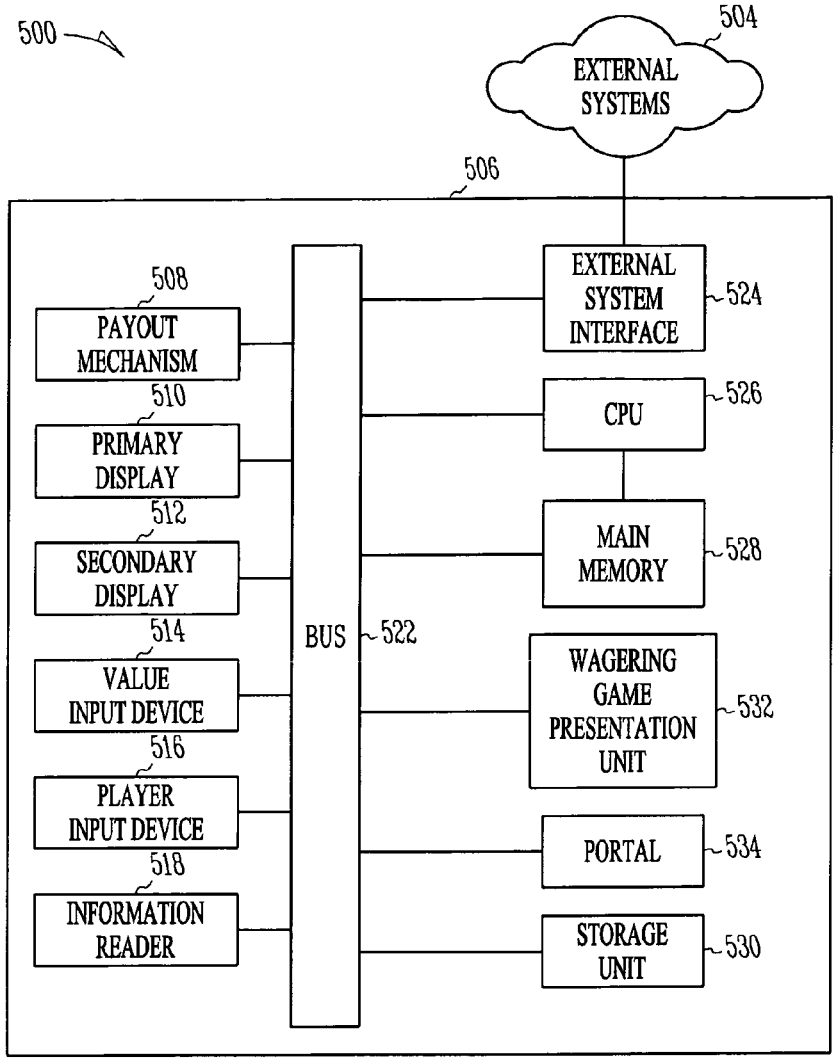
FIG. 5 shows a block diagram of features of an embodiment of an architecture for a wagering game system.

FIG. 5 shows a block diagram illustrating an embodiment of a wagering game machine architecture 500 having a wagering game machine 506. Wagering game machine architecture 500 may be arranged to include features of an account based gaming system according to the teaching associated with FIGS. 1-4. Wagering game machine 506 may be adapted to receive a wager from a player in association with a wagering game to be presented to the player. Wagering game machine 506 may include a central processing unit (CPU) 526, a main memory 528, a wagering game presentation unit 532, and a portal 534. CPU 526 may be realized using various forms of a processor and/or a controller. Main memory 528 may be coupled through a bus 522 or directly to CPU 526 using a communication medium such as a memory bus. A bus may include command control lines, data lines, address lines, other communication lines, or combinations thereof.

From a player's perspective, a wagering game is a game whose player participation is initiated with the player placing a wager in some manner, in which the occurrence of an event having some probability of happening results in an award to the player tied in some manner to the player's wager. In various wagering games, the reward may be tied to the player's wager merely by placing the wager. A wagering game may include a game in which a wager is made in a different game, but an award is a possible outcome from the wagering game. A bonus wagering game is such a wagering game whose play is correlated to a base wagering game. In an embodiment, a progressive may be structured as a game, either as a base game or as a bonus game. Each wagering game, whether a base game or bonus game, may include the instrumentality to control or regulate the play of the wagering game, including the flow of signals and data within one or more devices. Such instrumentality may include hardware, software, firmware, or various combinations thereof. A wagering game may be realized using one or more units or modules that manage the play of the wagering game. In an embodiment, such units or modules may be realized using one or more components of wagering game machine architecture 500 or similar architecture.

Wagering game presentation unit 532 may be an independent unit in wagering game machine 506. Wagering game presentation unit 532 may include a processor and/or controller, memory, or combinations thereof. An independent wagering game presentation unit 532 may operate with CPU 526 and/or main memory via bus 522 or via a direct connection. Wagering game presentation unit 532 may be realized as integral to main memory 528. Wagering game presentation unit 532 may be realized having components in CPU 526 and in main memory 528. In various embodiments, wagering game presentation unit 532 may present, in whole or part, wagering games such as video poker, video black jack, video slots, video lottery, video role playing games having wagering content, etc. In various embodiments, wagering game presentation unit 532 may present, in whole or part, one or more progressive game instances.

A portal is an instrumentality that may provide personalized capabilities, provide a pathway to other content, or combinations thereof. A portal may use distributed applications, different numbers and types of software based components that couple two or more applications to enable data transfer between the applications, hardware to provide services from a number of different sources, and may be realized on a variety of platforms such as servers, content management systems, personal computers (PCs), personal digital assistants (PDAs), mobile phones, stand-alone wagering game machines, distributed wager game machines, or combinations thereof. A portal may include or provide access to subroutine code, code libraries, application program interfaces such as interpreters utilizing Java EE™, Simple DirectMedia Layer™ (SDL) and DirectX™, or combinations thereof. Portal 534 may be realized in a variety of ways including, but not limited to, arranged as an independent component, embedded in wagering game presentation unit 532, embedded in main memory 528, distributed among CPU 526 and wagering game presentation unit 532, distributed among main memory 528 and wagering game presentation unit 532, distributed among CPU 526, main memory 528, and wagering game presentation unit 532, distributed among different components of wagering game machine architecture 500, distributed among different components of wagering game machine architecture 500 and external systems 504, or various combinations thereof. Portal 534 may be physically exterior to wagering game machine 506.

In an embodiment, portal 534 may be adapted to control selection of a progressive game from a set of progressive games. Upon a winning event tied to the selection of the progressive game, portal 534 may be used to communicate that a particular player or player account has won the progressive award to trigger transfer of funds from the progressive game instance account to the particular player or player account in one or more accounting systems.

CPU 526 may be connected to bus 522 to facilitate communication between the components of wagering game machine 506 and other components and/or systems exterior to wagering game machine 506. Bus 522 may be configured as an input/output (I/O) bus 522. I/O bus 522 may be connected to a payout mechanism 508, primary display 510, secondary display 512, value input device 514, player input device 516, information reader 518, storage unit 530, or combinations thereof. Player input device 516 may include value input device 514 to the extent the player input device 516 may be used to place wagers. I/O bus 522 may also be connected to an external system interface 524, which may be connected to external systems 504 including, but not limited to, accounting systems, similar to accounting system 101 of FIG. 1, a wagering game network, and/or multiple wagering game networks. Devices, modules, or systems external to a wagering game machine 506 may be located on a wagering game network, which may be a local area network (LAN) or a wide area network (WAN).

In an embodiment, wagering game machine 506 may include additional peripheral devices and/or more than one of each component shown in FIG. 5. For example, in an embodiment, wagering game machine 506 may include multiple external system interfaces 524 and multiple CPUs 526. In an embodiment, any of the components may be integrated or subdivided. Additionally, in an embodiment, the components of wagering game machine 506 may be interconnected according to any suitable interconnection architecture (e.g., directly connected, hypercube, etc.). In an embodiment, wagering game machine 506 may be arranged to function as a central game controller with functions similar to those of central game controller 103 of FIG. 1.

In an embodiment, any of the components of wagering game machine 506 (e.g., wagering game presentation unit 532) may include hardware, firmware, and/or software for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 6:
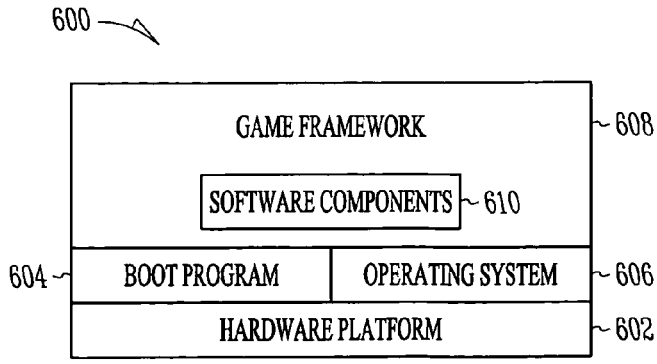
FIG. 6 shows a block diagram of features of an embodiment of an architecture for a wagering game system

FIG. 6 shows a block diagram of features of an embodiment of an architecture for a wagering game system 600. The wagering game architecture includes a hardware platform 602, a boot program 604, an operating system 606, and a game framework 608 that includes one or more wagering game software components 610. In various embodiments, hardware platform 602 may include a thin-client, thick-client, or some intermediate derivation. A thin client may be a client in client-server architecture networks which has little or no application logic, such that it depends primarily on a central server for processing activities. A thin client may use a small boot image to connect to a network and start up a dedicated web browser. A thin client may load its operating system (OS) and software from a server. A thin client may be a client in which no data is stored and relatively little processing occurs on the client machine. Thick clients may be full-featured computers that are connected to a network. A thick client, which may also be referenced as a heavy client, may be configured as functional machines, whether configured as a standalone machine or connected to a network, unlike typical thin clients that may lack hard drives and other features.

Hardware platform 602 may also be configured to provide a virtual client. Boot program 604 may include a basic input/output system (BIOS) or other initialization program that works in conjunction with operation system 606 to provide a software interface to hardware platform 602. Game framework 608 may include standardized game software components either independent or in combination with specialized or customized game software components that are designed for a particular wagering game. In an embodiment, wagering game software components 610 may include software operative in connection with hardware platform 602 and operating system 606 to present wagering games, in whole or part, such as video poker, video black jack, video slots, video lottery, video role playing games having wagering content, etc. In an embodiment, software components 610 may include software operative to accept a wager from a player. In an embodiment, software components 610 include one or more components to control implementation of a progressive as a persistent game instance. In an embodiment, software components 610 include one or more components to control assignment of account ownership to a game instance and to control conveyance of ownership functions to the game instance. According to an embodiment, one or more of the software components 610 may be provided as part of the operating system 606 or other software used in the wagering game system 600 (e.g., libraries, daemons, common services, etc.).

Figure 7:
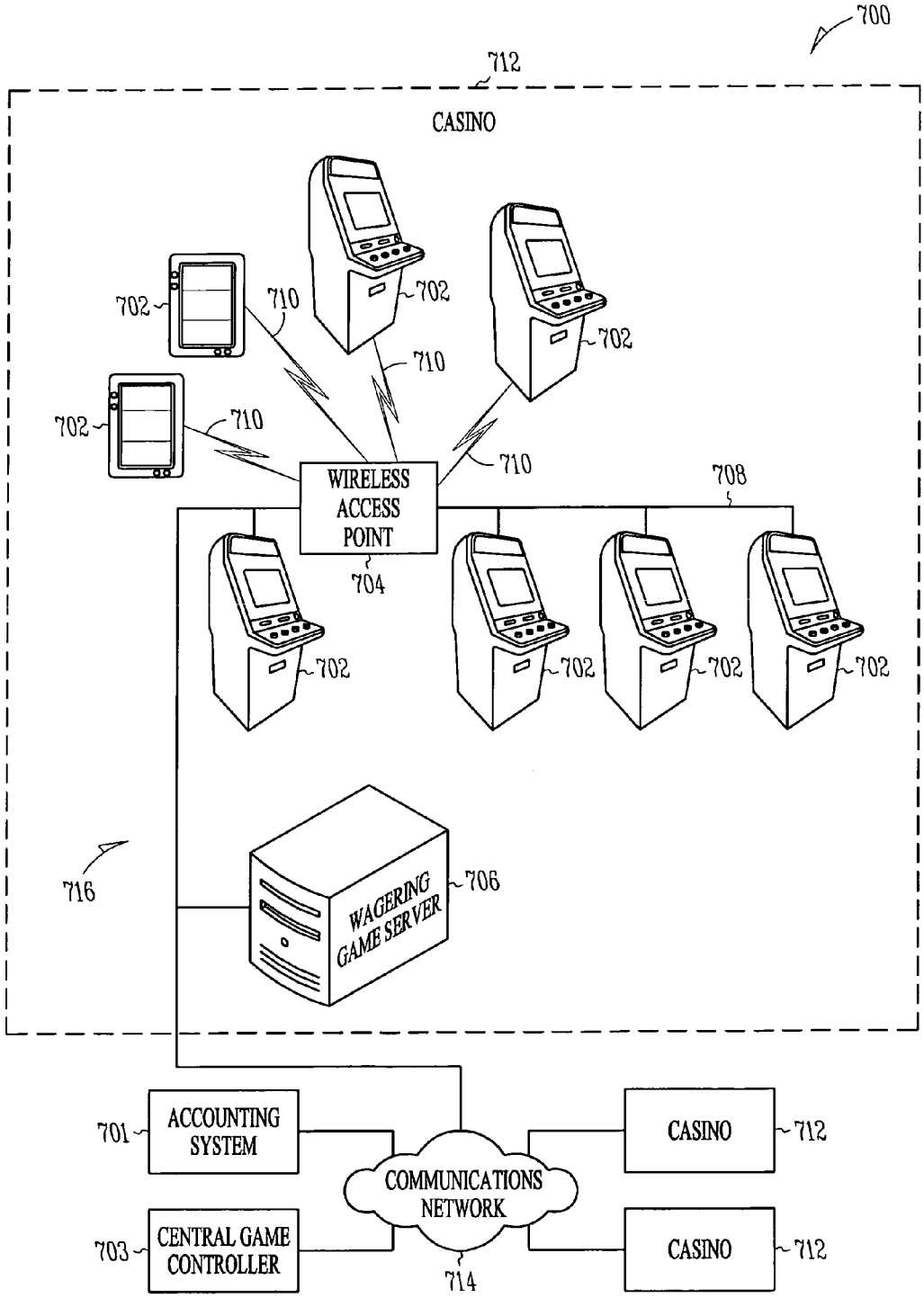
FIG. 7 shows a block diagram illustrating an embodiment of a wagering game network.

FIG. 7 shows a block diagram illustrating an embodiment of a wagering game network 700, according to example embodiments of the invention. Wagering game network 700 may include an accounting system 701, a central game controller 703, and multiple casinos 712 connected to a communications network 714. Accounting system 701 may include accounts assigned to game instances in which game instances may be conveyed ownership functions associated with financial accounts. Central game controller 703 may be structured to manage one or more game instances including progressive game instances. Central game controller 703 may be used to initiate a game generating a game instance. In an embodiment one or both of accounting system 701 or central game controller 703 may be located in one of multiple casinos. In an embodiment one or both of accounting system 701 or central game controller 703 may be configured as multiple units or modules distributed among multiple casinos 712.

Each casino 712 may include a local area network 716, which may include a wireless access point 704, wagering game machines 702, and a wagering game server 706 that may serve wagering games over the local area network 716. Wagering game server 706 may be a central game controller. Wireless access point 704 may control routing on both wireless communication channels and wired communication channels. Such a wireless access point 704 may be realized as a router capable of routing signals between and among wired devices, wireless devices, and devices having wired and wireless capability. In a non-wireless environment, wireless access point 704 may be replaced by a routing device. Local area network 716 may include wireless communication links 710 and wired communication links 708. The wired and wireless communication links may employ any suitable connection technology, such as Bluetooth, 802.11, Ethernet, public switched telephone networks, SONET, etc. In an embodiment, the wagering game server 706 may serve wagering games and/or distribute content to devices located in other casinos 712 or at other locations on communications network 714. In an embodiment, the wagering game server 706 may serve as a central game controller. With a wagering game server 706 serving as a central game controller, separate central game controller 703 may be an optional system in wagering game network 700. Wagering game machines 702 and wagering game server 706 may include hardware and machine-readable media including instructions for performing embodiments of the operations described herein.

Wagering game machines 702 described herein may take any suitable form, such as floor standing models, handheld mobile units, bartop models, workstation-type console models, etc. Further, wagering game machines 702 may be primarily dedicated for use in conducting wagering games, or may include non-dedicated devices, such as mobile phones, personal digital assistants, personal computers, etc. In an embodiment, the wagering game network 700 may include other network devices, such as multiple accounting servers, conventional wide area progressive servers, player tracking servers, and/or other devices suitable for use in connection with embodiments of the invention.

In various embodiments, wagering game machines 702 and wagering game servers 706 work together such that wagering game machine 702 may be operated as a thin, thick, or intermediate client. For example, one or more elements of game play may be controlled by wagering game machine 702 (client) or the wagering game server 706 (server). Game play elements may include executable game code, lookup tables, configuration files, game outcome, audio or visual representations of the game, game assets or the like. In a thin-client example, wagering game server 706 may perform functions such as determining game outcome or managing assets, while wagering game machine 702 may be used merely to present the graphical representation of such outcome or asset modification to the user (e.g., player). In a thick-client example, game outcome may be determined locally (e.g., at wagering game machine 702) and then communicated to wagering game server 706 for recording or managing a player's account.

Similarly, functionality not directly related to game play may be controlled by wagering game machine 702 (client) or the wagering game server 706 (server) in embodiments. For example, power conservation controls that manage a display screen's light intensity may be managed centrally (e.g., by wagering game server 706) or locally (e.g., by wagering game machine 702). Other functionality not directly related to game play may include presentation of advertising, software or firmware updates, system quality or security checks, etc.

In various embodiments, wireless access point 704 and wagering game machines 702 may communicate using orthogonal frequency division multiplexed (OFDM) communication signals over a multicarrier communication channel. The multicarrier communication channel may be within a predetermined frequency spectrum and may include multiple orthogonal subcarriers. In some embodiments, the multicarrier signals may be defined by closely spaced OFDM subcarriers. Each subcarrier may have a null at substantially a center frequency of the other subcarriers and/or each subcarrier may have an integer number of cycles within a symbol period. In some embodiments, wireless access point 704 and wagering game machines 702 may communicate in accordance with a broadband multiple access technique, such as orthogonal frequency division multiple access (OFDMA). In some embodiments, wireless access point 704 and wagering game machines 702 may communicate using spread-spectrum signals.

In various embodiments, wireless access point 704 may be part of a communication station, such as wireless local area network (WLAN) communication station including a Wireless Fidelity (WiFi) communication station, or a WLAN access point (AP). In these embodiments, wagering game machines 702 may be part of a mobile station, such as WLAN mobile station or a WiFi mobile station.

In various embodiments, wireless access point 704 may be part of a broadband wireless access (BWA) network communication station, such as a Worldwide Interoperability for Microwave Access (WiMax) communication station, as wireless access point 704 may be part of almost any wireless communication device. In these embodiments, wagering game machines 702 may be part of a BWA network communication station, such as a WiMax communication station.

In various embodiments, any of wagering game machines 702 may be part of a portable wireless communication device, such as a personal digital assistant, a laptop or portable computer with wireless communication capability, a web tablet, a wireless telephone, a wireless headset, a pager, an instant messaging device, a digital camera, a television, or other device that may receive and/or transmit information wirelessly.

In various embodiments, wireless access point 704 and wagering game machines 702 may communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they may also be suitable to transmit and/or receive communications in accordance with other techniques and standards. In some BWA network embodiments, wireless access point 704 and wagering game machines 702 may communicate RF signals in accordance with the IEEE 802.16-2004 and the IEEE 802.16(e) standards for wireless metropolitan area networks (WMANs) including variations and evolutions thereof. However, they may also be suitable to transmit and/or receive communications in accordance with other standards and techniques including communicating using proprietary protocols.

In various embodiments, wireless access point 704 and wagering game machines 702 may communicate in accordance with standards such as the Pan-European mobile system standard referred to as the Global System for Mobile Communications (GSM). In some embodiments, wireless access point 704 and wagering game machines 702 may also communicate in accordance with packet radio services such as the General Packet Radio Service (GPRS) packet data communication service. In some embodiments, wireless access point 704 and wagering game machines 702 may communicate in accordance with the Universal Mobile Telephone System (UMTS) for the next generation of GSM, which may, for example, implement communication techniques in accordance with 2.5G and third generation (3G) wireless standards. In some of these embodiments, wireless access point 704 and wagering game machines 702 may provide packet data services (PDS) utilizing packet data protocols (PDP). In other embodiments, wireless access point 704 and wagering game machines 702 may communicate in accordance with other standards or other air-interfaces including interfaces compatible with the enhanced data for GSM evolution (EDGE) standards.

In other embodiments, wireless access point 704 and wagering game machines 702 may communicate in accordance with a short-range wireless standard, such as the Bluetooth™ short-range digital communication protocol. Bluetooth™ wireless technology is a de facto standard, as well as a specification for small-form factor, low-cost, short-range radio links between mobile PCs, mobile phones and other portable devices. (Bluetooth is a trademark owned by Bluetooth SIG, Inc.) In other embodiments, wireless access point 704 and wagering game machines 702 may communicate in accordance with an ultra-wideband (UWB) communication technique where a carrier frequency is not used. In other embodiments, wireless access point 704 and wagering game machines 702 may communicate in accordance with an analog communication technique. In other embodiments, wireless access point 704 and wagering game machines 702 may communicate in accordance with an optical communication technique, such as the Infrared Data Association (IrDA) standard. In some embodiments, wireless access point 704 and wagering game machines 702 may communicate in accordance with the Home-RF standard which may be in accordance with a Home-RF Working Group (HRFWG) standard.

Figure 8:
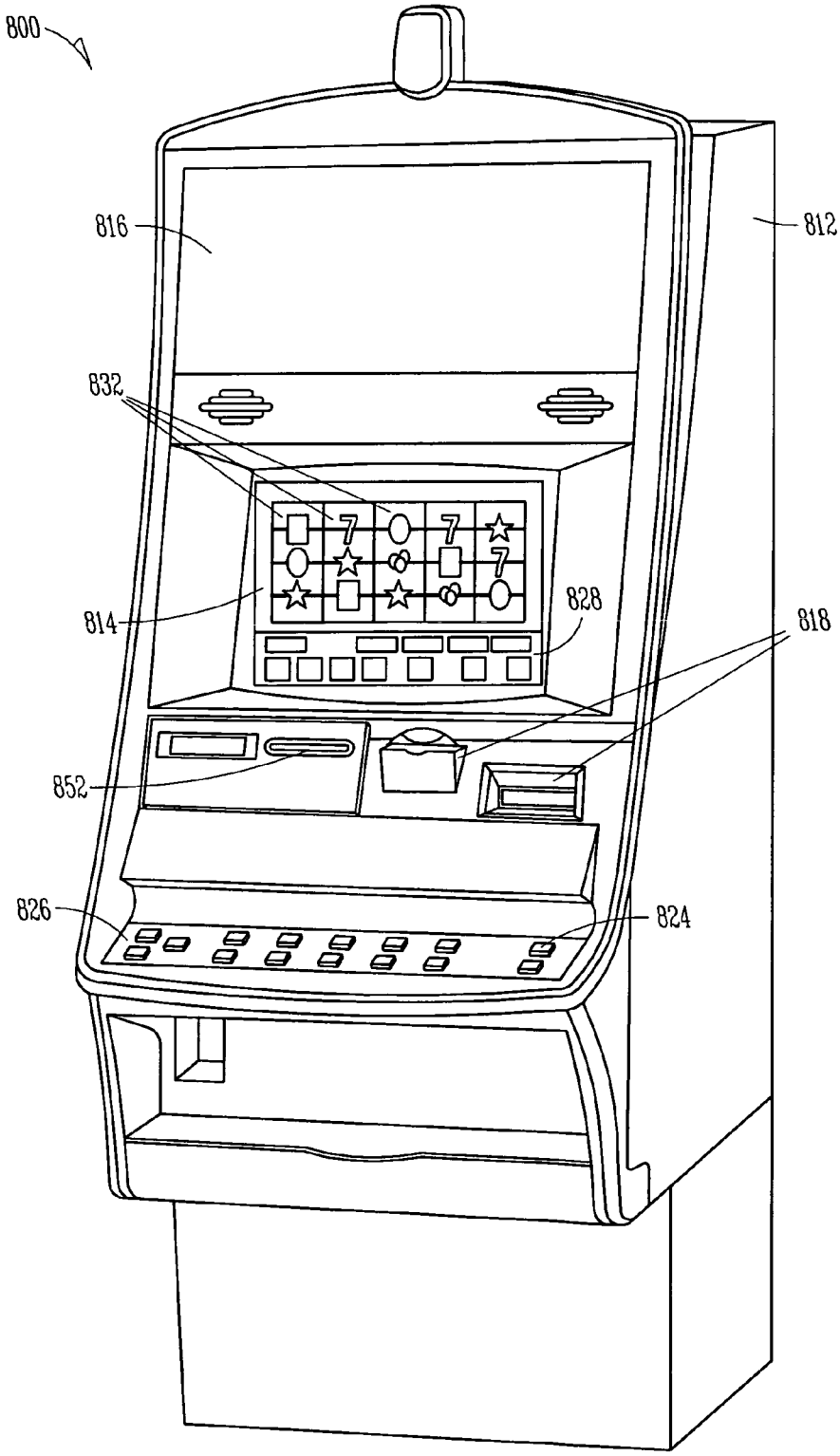
FIG. 8 illustrates an example embodiment of a wagering game machine.

FIG. 8 illustrates an embodiment of a wagering game machine 800 in which a wagering game may be displayed and/or entered into by a player. A player beginning a wagering game may generate a game instance and an account for the game instance in an accounting system in communication with wagering game machine 800. Embodiments of progressive game instances may be displayed on wagering game machine 800. Wagering game machine 800 may be used in gaming establishments, such as casinos. In various embodiments, wagering game machine 800 may be any type of wagering game machine and may have varying structures and methods of operation. For example, wagering game machine 800 may be an electromechanical wagering game machine configured to play mechanical slots, or it may be an electronic wagering game machine configured to play video casino games, such as blackjack, slots, keno, poker, blackjack, roulette, video role playing games having wagering content, etc.

Wagering game machine 800 may include a housing 812 having input devices that may include value input devices 818 and a player input device 824. For output, wagering game machine 800 may include a primary display 814 for displaying information about a basic wagering game. Primary display 814 may also display information about a bonus wagering game and a progressive wagering game.

Wagering game machine 800 also may include a secondary display 816 for displaying wagering game events, wagering game outcomes, and/or signage information. While some components of wagering game machine 800 are described herein, numerous other elements may exist and may be used in any number or combination to create varying forms of wagering game machine 800.

Value input devices 818 may take any suitable form and may be located on the front of housing 812. Value input devices 818 may receive currency and/or credits inserted by a player. Value input devices 818 may include coin acceptors for receiving coin currency and bill acceptors for receiving paper currency. Furthermore, value input devices 818 may include ticket readers or barcode scanners for reading information stored on vouchers, cards, or other tangible portable storage devices. The vouchers or cards may authorize access to central accounts, which may transfer money to wagering game machine 800.

Player input device 824 may include multiple push buttons on a button panel 826 for operating wagering game machine 800. In addition, or alternatively, player input device 824 may include a touch screen 828 mounted over primary display 814 and/or secondary display 816.

The various components of wagering game machine 800 may be connected directly to, or contained within, housing 812. Alternatively, some components of the wagering game machine may be located outside of housing 812, while being communicatively coupled with wagering game machine 800 using any suitable wired or wireless communication technology.

The operation of the basic wagering game may be displayed to the player on primary display 814. Primary display 814 may also display a bonus game associated with the basic wagering game. Primary display 814 may include a cathode ray tube (CRT), a high resolution liquid crystal display (LCD), a plasma display, light emitting diodes (LEDs), or any other type of display suitable for use in wagering game machine 800. Alternatively, primary display 814 may include a number of mechanical reels to display the outcome. Wagering game machine 800 may be an "upright" version, as shown in FIG. 8, in which primary display 814 is oriented vertically relative to the player. Alternatively, wagering game machine 800 may be a "slant-top" version in which primary display 814 is slanted at about a thirty-degree angle toward the player of wagering game machine 800. In an embodiment, wagering game machine 800 may exhibit any suitable form factor, such as a free standing model, bartop model, mobile handheld model, or workstation console model.

A player begins playing a basic wagering game by making a wager via value input device 818. The player may initiate play by using the player input device's buttons or touch screen 828. The basic game may include arranging multiple symbols along a pay line 832, which indicates one or more outcomes of the basic game. Pay line 832 may be realized as multiple pay lines. Pay line 832 need not be limited to horizontal lines, but may be arranged in a variety of ways including diagonal lines, vertical lines, or zigzag lines. Such outcomes may be randomly selected in response to player input. One of the outcomes, which may include any variation or combination of symbols, may trigger a bonus game.

In some embodiments, wagering game machine 800 may also include an information reader 852, which may include a card reader, ticket reader, bar code scanner, RFID transceiver, or computer readable storage medium interface. In some embodiments, information reader 852 may be used to award complimentary services, restore game assets, track player habits, etc.

Figure 9:
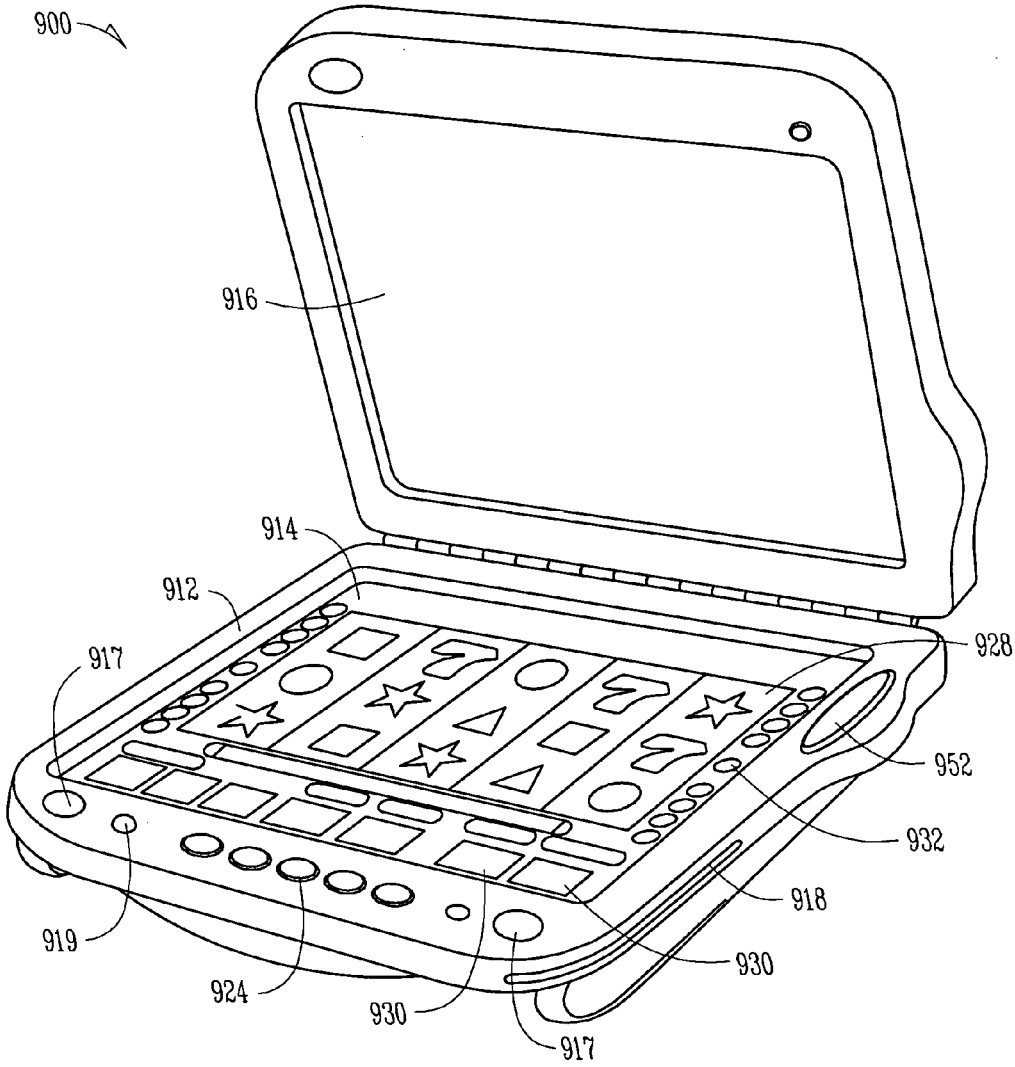
FIG. 9 illustrates an example embodiment of a wagering game machine.

FIG. 9 illustrates an example embodiment of a wagering game machine 900 in which a wagering game generated in accordance with an embodiment of the present invention may be displayed and/or entered into by a player. A player beginning a wagering game may generate a game instance and an account for the game instance in an accounting system in communication with wagering game machine 900. Embodiments of progressive game instances may be displayed on wagering game machine 900. Like free standing wagering game machines, in a handheld or mobile form, wagering game machine 900 may include any suitable electronic device configured to play video casino games such as blackjack, slots, keno, poker, blackjack, roulette, and video role playing games having wagering content. Wagering game machine 900 may include a housing 912 having input devices such as a value input device 918 and a player input device 924. For output, wagering game machine 900 may include a primary display 914, a secondary display 916, one or more speakers 917, one or more player-accessible ports 919 (e.g., an audio output jack for headphones, a video headset jack, etc.), and other I/O devices and ports, which may or may not be player-accessible. Wagering game machine 900 may include a secondary display 916 that is rotatable relative to primary display 914. Optional secondary display 916 may be fixed, movable, and/or detachable/attachable relative to primary display 914. Either primary display 914 and/or secondary display 916 may be configured to display any portion or feature of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

Player-accessible value input device 918 may include, for example, a slot located on the front, side, or top of housing 912 configured to receive credit from a stored-value card (e.g., casino card, smart card, debit card, credit card, etc.) inserted by a player. The player-accessible value input device 918 may also include a sensor (e.g., an RF sensor) configured to sense a signal (e.g., an RF signal) output by a transmitter (e.g., an RF transmitter) carried by a player. The player-accessible value input device 918 may also, or alternatively, include a ticket reader or barcode scanner for reading information stored on a credit ticket, a card, or other tangible portable credit or funds storage device. The credit ticket or card may also authorize access to a central account, which may transfer money to wagering game machine 900.

Still other player-accessible value input devices 918 may make use of touch keys 930 on the touch-screen display (e.g., primary display 914 and/or secondary display 916) or player input devices 924. In an embodiment, upon entry of player identification information and secondary authorization information (e.g., a password, PIN number, stored value card number, predefined key sequences, etc.), the player may be permitted to access a player's account. As an optional security feature, wagering game machine 900 may be configured to permit a player to only access an account the player has specifically set up for wagering game machine 900. Other conventional security features may also be utilized to, for example, prevent unauthorized access to a player's account, to minimize an impact of any unauthorized access to a player's account, or to prevent unauthorized access to any personal information or funds temporarily stored on wagering game machine 900.

Player-accessible value input device 918 may itself include or utilize a biometric player information reader which permits the player to access available funds on a player's account, either alone or in combination with another of the aforementioned player-accessible value input devices 918. In an embodiment where player-accessible value input device 918 includes a biometric player information reader, transactions may be authorized by a biometric reading from the biometric device, which may include multiple biometric readings. Such transactions may include, for example, an input of value to wagering game machine 900, a transfer of value from a player account or source to an account associated with wagering game machine 900, or the execution of another transaction.

Alternatively, to enhance security, a transaction may be optionally enabled only by a two-step process in which a secondary source confirms the identity indicated by a primary source. For example, player-accessible value input device 918 may include a biometric player information reader that may use a confirmatory entry from another biometric player information reader 952, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Any two independent sources of identity, one of which is secure or personal to the player (e.g., biometric readings, PIN number, password, etc.) may be utilized to provide enhanced security prior to the electronic transfer of any funds. Value input device 918 may be provided remotely from wagering game machine 900.

Player input device 924 may include multiple push buttons on a button panel for operating wagering game machine 900. In addition, or alternatively, player input device 924 may include a touch screen mounted to a primary display 914 and/or secondary display 916. The touch screen may be matched to a display screen having one or more selectable touch keys 930 selectable by a user's touching of the associated area of the screen using a finger or a tool, such as a stylus pointer. A player enables a desired function either by touching the touch screen at an appropriate touch key 930 or by pressing an appropriate, push button on the button panel. Touch keys 930 may be used to implement the same functions as push buttons. Alternatively, push buttons 932 may provide inputs for operating one part of the game, while touch keys 930 may allow for input needed for another part of the game. The various components of wagering game machine 900 may be connected directly to, or contained within, housing 912 or may be located outside housing 912 and connected to housing 912 via a variety of wired (tethered) or wireless connection methods. Thus, wagering game machine 900 may be configured as a single unit or as multiple interconnected (e.g., wireless connections) parts, which may be arranged to suit a player's preferences.

The operation of the basic wagering game on wagering game machine 900 may be displayed to the player on primary display 914. Primary display 914 may also display one or more bonus games associated with the basic wagering game. Primary display 914 may take the form of a high resolution LCD, a plasma display, an LED, or any other type of display suitable for use in wagering game machine 900. The size of primary display 914 may vary from, for example, about a 2-3"

display to a 15" or 17" display. In some embodiments, primary display 914 is a 7"-10" display. However, primary display 914 is not limited to the above sizes. In an embodiment, the size of the primary display may be increased. Optionally, coatings or removable films or sheets may be applied to the display to provide desired characteristics (e.g., anti-scratch, anti-glare, bacterially-resistant and anti-microbial films, etc.). In various embodiments, primary display 914 and/or secondary display 916 may have a 16:9 aspect ratio or other aspect ratio (e.g., 4:3). Primary display 914 and/or secondary display 916 may also each have different resolutions, different color schemes, and different aspect ratios.

As with free standing embodiments, a player begins play of the basic wagering game on wagering game machine 900 by making a wager (e.g., via value input device 918 or an assignment of credits stored on the handheld gaming machine via touch screen keys 930, player input device 924, or buttons 932) on wagering game machine 900. In various embodiments, a wagering game may include multiple symbols arranged in an array and may include at least one pay line 928 that indicates one or more outcomes of the wagering game. Pay line 928 may be realized as multiple pay lines. Pay line 928 may be horizontal lines or may be arranged in a variety of ways, including diagonal lines, vertical lines, or zigzag lines. Such outcomes may be randomly selected in response to the wagering input by the player. One or more randomly selected outcomes may be a start-bonus outcome, which may include any variations of symbols or symbol combinations triggering a bonus game.

In various embodiments, player-accessible value input device 918 of wagering game machine 900 may double as a player information reader 952 that allows for identification of a player by reading a card with information indicating the player's identity (e.g., reading a player's credit card, player ID card, smart card, etc.). Player information reader 952 may alternatively or also include a bar code scanner, RFID transceiver or computer readable storage medium interface. In an embodiment, player information reader 952 may include a biometric sensing device.

In the above detailed description, reference may be made to specific examples by way of drawings and illustrations. It is to be understood that the above description is intended to be illustrative, and not restrictive, and that the phraseology or terminology employed herein is for the purpose of description. These examples are described in sufficient detail to enable those skilled in the art to practice embodiments of the inventive subject matter, and serve to illustrate how the inventive subject matter may be applied to various purposes or embodiments. Other embodiments may be included within the inventive subject matter, as logical, mechanical, electrical, and other changes may be made to the example embodiments described herein. The various embodiments are not necessarily mutually exclusive, as some embodiments may be combined with one or more other embodiments to form new embodiments. Features or limitations of various embodiments described herein do not limit the inventive subject matter as a whole, and any reference to the invention, its elements, operation, and application are not limiting as a whole, but serve only to define these example embodiments. The above detailed description does not, therefore, limit embodiments of the invention.

What is claimed is:

1. A computer-implemented accounting method of managing financial transactions occurring in one or more wagering games conducted by a gaming system, the method comprising:

initiating a game instance of one of the one or more wagering games at a gaming machine;

opening, via one or more processors, a financial account of funds of the game instance and assigning ownership of the financial account to the game instance;

receiving, via at least one input device, a wager related to the game instance and depositing a corresponding credit value of the wager into the assigned account;

randomly generating, via the one or more processors, an outcome in the game instance;

in response to the outcome resulting in a credit award, adding the credit award to the assigned financial account; and in response to the termination of the game instance, closing the assigned financial account.

2. The method of claim 1, wherein closing the assigned financial account includes at least one of:

transferring funds from the assigned financial account into another account; and paying out funds from the assigned financial account to a player.

3. The method of claim 2, wherein closing the assigned financial account further includes transferring a balance of the assigned financial account to a system account.

4. The method of claim 2, wherein the another account is a player account.

5. The method of claim 1, wherein initiating the game instance is caused by receiving the wager.

6. The method of claim 1, wherein the wager contributes to funding the credit award.

7. The method of claim 1, wherein receiving a wager includes transferring funds from a player account to the assigned account.

8. The method of claim 1, wherein the game instance is assigned ownership of multiple accounts.

9. The method of claim 1, wherein the financial account is part of an account based gaming system.

10. The method of claim 1, wherein the corresponding credit value is a first portion of the wager, and further comprising depositing a second portion of the wager in a discretionary account.

11. The method of claim 10, wherein the discretionary account is controlled by one of a game owner, a game publisher, a casino, and another entity.

12. The method of claim 10, wherein the discretionary account is used to fund awards provided only to selected players.

13. A computer-implemented accounting method of managing financial transactions occurring in a progressive wagering game conducted by a gaming system, the method comprising:

initiating a persistent instance of a progressive wagering game;

opening, via one or more progressive processors, a first account of funds of the persistent instance and assigning ownership of the first account to the persistent instance;

receiving, via at least one input device, a wager initiating a game instance of a participating wagering game;

opening, via one or more game processors, a second account of funds of the game instance and assigning ownership of the second account to the game instance, depositing a first portion of the wager in the first account and a second portion of the wager in the second account;

randomly generating, via one or more game processors, an outcome of the game instance;

in response to the outcome resulting in a progressive award, awarding the progressive award to a player;

in response to the outcome resulting in a participating game award, adding a corresponding credit award to the second account; and in response to the termination of the game instance, closing the second account.

14. The method of claim 13, wherein closing the second account includes at least one of:

transferring funds from the second account into a third account; and paying out funds from the second account to a player.

15. The method of claim 14, wherein closing the second account further includes transferring a balance of the second account into a system account.

16. The method of claim 14, wherein the third account is a player account.

17. The method of claim 13, wherein at east some of the one or more progressive processors are included in the one or more game processors.

18. The method of claim 13, wherein the progressive award is at least partially funded by the first portion of the wager.

19. The method of claim 13, further comprising, in response to the outcome resulting in a supplementary award that is funded from a supplementary account separate from the first account, withdrawing the supplementary award from the supplementary account and awarding the supplementary award to a player.

20. The method of claim 19, wherein the supplementary award is a mystery pay progressive.

21. The method of claim 19, wherein the supplementary account is funded independently of the wager.

22. A gaining system configured to perform financial transactions related to one or more wagering games, the system comprising:

at least one input device;

one or more processors; and at least one memory device storing instructions that, when executed by the one or more processors, cause the one or more processors to operate with the at least one input device to:

initiate a game instance of one of the one or more wagering games;

open a financial account of funds of the game instance and assign ownership of the financial account to the game instance;

receive a wager related to the game instance and deposit a corresponding credit value in the assigned financial account;

randomly generate an outcome in the game instance; and in response to the outcome resulting in a credit award, add the credit award to the assigned financial account; and in response to the termination of the game instance, close the assigned financial account.

23. The gaming system of claim 22, wherein to close the assigned financial account includes at least one of:

transfer funds from the assigned financial account into another account; and pay out funds from the assigned financial account to a player.

24. The gaming system of claim 23, wherein closing the assigned financial account further includes transferring a balance of the assigned financial account to a system account.

25. The gaming system of claim 23, wherein the another account is a player account.

26. The gaming system of claim 22, wherein initiating the game instance is caused by receiving the wager.

27. The gaming system of claim 22, wherein the wager contributes to funding the credit award.

28. The gaming system of claim 22, wherein receiving a wager includes transferring funds from a player account to the assigned account.

29. The gaming system of claim 22, wherein the game instance is assigned ownership of multiple accounts.

30. The gaming system of claim 22, wherein the financial account is part of an account based gaming system.

31. The gaming system of claim 22, wherein the corresponding credit value is a first portion of the wager, and further comprising depositing a second portion of the wager in a discretionary account.

32. The gaming system of claim 31, wherein the discretionary account is controlled by an independent entity.

33. The gaming system of claim 31, wherein the discretionary account is used to fund awards provided only to selected players.

34. The gaming system of claim 22, wherein the at least one input device, the one or more processors, and the memory device are connected for communication across a gaming network.

35. The gaming system of claim 34, further comprising a game server connected to the gaming network, and wherein one of the at least one input device, the one or more processors, and the memory device reside on the game server.

36. A gaming system configured to manage financial transactions related to one or more wagering games, the system comprising:

a plurality of gaming machines, each gaming machine of the plurality including at least one input device;

a central game controller including one or more processors; and at least one memory device storing instructions that, when executed by the central game controller, cause the central game controller to operate with the plurality of gaming machines to initiate at game instance of the one or more wagering games, at a gaming machine of the plurality of gaming machines;

receive a selection of a major and a minor progressive instance of a plurality of available progressive instances;

open a game account for the game instance and assign ownership of the game account to the game instance;

receive a wager related to the game instance and deposit a first portion of the wager in the game account, a second portion in a major account owned by the major progressive instance, and a third portion in a minor account owned by the minor progressive;

randomly generate an outcome for the game instance; and in response to the outcome resulting in a major progressive award, award the major progressive award to a player; and in response to the outcome resulting in a minor progressive award, award the minor progressive award to the player;

in response to the outcome resulting in a game award, adding a corresponding credit award to the game account; and in response to the termination of the game instance, closing the game account.

37. The gaming system of claim 36, wherein the plurality of available progressive instances is determined by a wager amount.

38. The gaming system of claim 36, wherein a player selects the major and minor progressive instances.

39. The gaming system of claim 38, wherein the selection of one of the major and minor progressive instances requires an additional wager.

40. A computer-readable, non-transitory medium including executable instructions that cause a gaming system to perform the method comprising:

initiating a persistent instance of a progressive wagering game;

opening, via one or more progressive processors, a first account of funds of the persistent instance and assigning ownership of the first account to the persistent instance;

receiving, via at least one input device, a wager initiating a game instance of a participating wagering game;

opening, via one or more game processors, a second account of funds of the game instance and assigning ownership of the second account to the game instance, depositing a first portion of the wager in the first account and a second portion of the wager in the second account;

randomly generating, via one or more game processors, an outcome of the game instance;

in response to the outcome resulting in a progressive award, awarding the progressive award to a player;

in response to the outcome resulting in a participating game award, adding a corresponding credit award to the second account; and in response to the termination of the game instance, closing the second account.

41. The computer-readable medium of claim 40, wherein closing the second account further includes transferring a balance of the second account to a system account.

42. The computer-readable medium of claim 40, wherein the gaming system comprises a plurality of gaming machines and the game instance is initiated on a gaming machine from the plurality of gaming machines.

43. The computer-readable medium of claim 42, wherein the plurality of gaming machines are connected for communication to a gaming network, and the medium resides on a game server connected to the gaming network.

44. The computer-readable medium of claim 40, wherein initiating the progressive instance includes receiving a selection of the at least one progressive wagering game of a plurality of available progressive wagering games.

* * * * *

UNITED STATES PATENT AND TRADEMARK OFFICE

CERTIFICATE OF CORRECTION

PATENT NO. : 8,118,668 B2
APPLICATION NO. : 12/524071
DATED : February 21, 2012
INVENTOR(S) : Mark B. Gagner et al.

It is certified that error appears in the above-identified patent and that said Letters Patent is hereby corrected as shown below:

In column 2, line 23, after "system" insert -- . --.

In column 16, line 47, delete "appropriate," and insert -- appropriate --, therefor.

In column 19, line 17, in Claim 17, delete "east" and insert -- least --, therefor.

In column 19, line 32, in Claim 22, delete "gaining" and insert -- gaming --, therefor.

Signed and Sealed this
Nineteenth Day of June, 2012

David J. Kappos

David J. Kappos
*Director of the United States Patent and Trademark Office*